US010760338B2

(12) United States Patent
Russell et al.

(10) Patent No.: US 10,760,338 B2
(45) **Date of Patent: *Sep. 1, 2020**

(54) LADDER SECURING APPARATUSES, LADDERS INCORPORATING SAME AND RELATED METHODS

(71) Applicant: Wing Enterprises, Incorporated, Springville, UT (US)

(72) Inventors: Brian B. Russell, Saratoga Springs, UT (US); N. Ryan Moss, Mapleton, UT (US); Sean R. Peterson, Payson, UT (US); Darius S. Penrod, Elberta, UT (US); Ryan Crawford, Salem, UT (US); Gary Jonas, Springville, UT (US)

(73) Assignee: WING ENTERPRISES, INCORPORATED, Springville, UT (US)

( * ) Notice: Subject to any disclaimer, the term of this patent is extended or adjusted under 35 U.S.C. 154(b) by 63 days.

This patent is subject to a terminal disclaimer.

(21) Appl. No.: 15/226,413

(22) Filed: Aug. 2, 2016

(65) Prior Publication Data

US 2017/0030142 A1 Feb. 2, 2017

Related U.S. Application Data

(62) Division of application No. 14/049,927, filed on Oct. 9, 2013, now Pat. No. 9,404,306.

(Continued)

(51) Int. Cl.

| | |
|---|---|
| ***E06C 7/48*** | (2006.01) |
| ***E06C 7/18*** | (2006.01) |
| ***E06C 1/36*** | (2006.01) |

(52) U.S. Cl.

CPC ..... *E06C 7/48* (2013.01); *E06C 1/36* (2013.01); *E06C 7/188* (2013.01)

(58) Field of Classification Search

CPC ... E06C 1/36; E06C 7/48; E06C 7/486; E06C 7/488; E06C 7/186; E06C 7/188

See application file for complete search history.

(56) References Cited

U.S. PATENT DOCUMENTS 283,530 A 8/1883 Swartz
285,637 A * 9/1883 Manahan ..... E06C 7/48 182/206

(Continued)

FOREIGN PATENT DOCUMENTS

CN 201502313 U 6/2010
CN 201802297 U 4/2011

(Continued)

OTHER PUBLICATIONS

Definition of "with" provided in Action The American Heritage® Dictionary of the English Language, Fourth Edition, copyright © 2000 by Houghton Mifflin Company, updated in 2009, published by Houghton Mifflin Company. All rights reserved.

(Continued)

*Primary Examiner* — Daniel P Cahn
(74) *Attorney, Agent, or Firm* — Dorsey & Whitney LLP

(57) ABSTRACT

A ladder is provided comprising a first pair of spaced apart rails and a plurality of rungs extending between and coupled to the first pair of spaced apart rails. A pair of hooks are located such that each hook is positioned adjacent and upper end of an associated rail. A securing apparatus is coupled adjacent the upper end of the first pair of spaced apart rails. The securing apparatus includes a pair of spaced apart engaging members and may include a cross-member coupled therebetween. Each of the engagement members is pivotal with respect to an associated rail of the first pair of (Continued)

spaced apart rails. In one embodiment, the securing apparatus lacks any biasing members (e.g., springs or actuators) or locking members. The engagement members and hooks cooperatively encircle and overhead, generally horizontal support member to support and secure the ladder in a desired position.

11 Claims, 13 Drawing Sheets

Related U.S. Application Data

(60) Provisional application No. 61/711,632, filed on Oct. 9, 2012.

(56) References Cited

U.S. PATENT DOCUMENTS

| | | | | | |
|---|---|---|---|---|---|
| 1,205,594 | A * | 11/1916 | Close | E06C 7/48 | 182/206 |
| 1,386,511 | A | 8/1921 | Krahl | | |
| 1,522,292 | A | 1/1925 | Enssle | | |
| 1,813,865 | A * | 7/1931 | Reese | E06C 1/36 | 182/206 |
| 1,961,289 | A | 6/1934 | Gardner | | |
| 2,008,895 | A | 7/1935 | August et al. | | |
| 2,432,781 | A | 12/1947 | Mann | | |
| 2,439,430 | A * | 4/1948 | Hurd | E06C 1/36 | 182/206 |
| 2,448,716 | A * | 9/1948 | Hurd | E06C 1/345 | 182/206 |
| 2,536,318 | A * | 1/1951 | Siler | E06C 1/125 | 182/108 |
| 2,797,037 | A | 6/1957 | Niedojadlo | | |
| 2,797,038 | A | 6/1957 | Tiberghien | | |
| 2,910,135 | A | 10/1959 | Moore | | |
| 3,037,579 | A | 6/1962 | Barrow | | |
| 3,115,211 | A * | 12/1963 | Ostrander, Jr. | E06C 7/12 | 182/103 |
| 3,136,384 | A | 6/1964 | Sweeney et al. | | |
| 3,336,999 | A | 8/1967 | McSwain | | |
| 3,486,580 | A * | 12/1969 | Norton | E06C 7/48 | 182/111 |
| 3,603,431 | A * | 9/1971 | Nameche | E06C 1/34 | 182/206 |
| 3,910,380 | A * | 10/1975 | Nameche | E06C 1/34 | 182/206 |
| 3,917,189 | A | 11/1975 | Bryll | | |
| 4,089,390 | A * | 5/1978 | McLain | E06C 1/36 | 182/206 |
| 4,128,228 | A | 12/1978 | Ziegelmann | | |
| 4,257,492 | A | 3/1981 | Rasada et al. | | |
| 4,279,327 | A * | 7/1981 | Warren | E06C 1/345 | 182/152 |
| 4,311,209 | A * | 1/1982 | Primerano | E06C 1/36 | 182/107 |
| 4,515,242 | A | 5/1985 | Lachance | | |
| 4,531,612 | A | 7/1985 | Sander | | |
| 4,531,613 | A * | 7/1985 | Keigher | E06C 1/10 | 182/163 |
| 4,552,246 | A | 11/1985 | Thomas | | |
| 4,593,790 | A | 6/1986 | Brewer et al. | | |
| 4,643,274 | A * | 2/1987 | Tataseo | E06C 7/48 | 182/106 |
| 5,054,581 | A * | 10/1991 | Henson | E06C 1/36 | 182/206 |
| 5,429,207 | A | 7/1995 | Frank et al. | | |
| 5,601,154 | A | 2/1997 | Eisenmenger | | |
| 5,850,894 | A | 12/1998 | Busenhart | | |
| 5,855,251 | A | 1/1999 | Deuer | | |
| 5,911,287 | A | 6/1999 | Campbell | | |
| 6,019,191 | A | 2/2000 | Flores | | |
| 6,021,865 | A | 2/2000 | Thompson et al. | | |
| 6,029,774 | A | 2/2000 | Cothern | | |
| 6,044,930 | A | 4/2000 | Hayman | | |
| 6,138,794 | A | 10/2000 | Staal | | |
| 6,158,549 | A | 12/2000 | Hartman | | |
| 6,244,382 | B1 | 6/2001 | Labonte | | |
| 6,250,424 | B1 | 6/2001 | Laug | | |
| 6,883,642 | B2 | 4/2005 | Matty | | |
| 7,219,766 | B2 | 5/2007 | Deuer | | |
| 8,011,476 | B1 | 9/2011 | Alcon | | |
| 8,776,947 | B1 * | 7/2014 | Wurth | E06C 1/12 | 14/69.5 |
| 9,382,759 | B2 * | 7/2016 | Bolinski | E06C 7/188 | |
| 9,404,306 | B2 * | 8/2016 | Russell | E06C 7/48 | |
| 9,593,531 | B2 * | 3/2017 | Ballard | E06C 7/48 | |
| 2005/0045421 | A1 | 3/2005 | Gaines | | |
| 2005/0284703 | A1 * | 12/2005 | Deuer | E06C 1/36 | 182/206 |
| 2008/0202851 | A1 | 8/2008 | Schwenke et al. | | |
| 2009/0000868 | A1 | 1/2009 | Gaines | | |
| 2009/0242328 | A1 * | 10/2009 | Cabrera | E06C 7/06 | 182/111 |
| 2010/0038172 | A1 | 2/2010 | Ralston | | |
| 2010/0300805 | A1 | 12/2010 | Moss et al. | | |
| 2010/0326768 | A1 | 12/2010 | Kerstetter | | |
| 2014/0105575 | A1 | 4/2014 | Nishikawa et al. | | |

FOREIGN PATENT DOCUMENTS

| | | | |
|---|---|---|---|
| EP | 0232206 | A2 | 8/1987 |
| EP | 0771931 | A1 | 5/1997 |
| GB | 2459118 | A | 10/2009 |
| GB | 2476283 | A1 | 6/2011 |
| GB | 2480890 | A | 12/2011 |
| JP | 2000248865 | A | 9/2000 |

OTHER PUBLICATIONS

Definition of "adjacent" provided in Action Collins English Dictionary—Complete and Unabridged ©, Harper Collins Publishers, 1991, 1994, 1998, 2000, 2003.

APC, Ladder Bracket Kit (AR8168BLK)—Installation. Obtained from http://www.apcmedia.com/salestools/ASTE-6Z6KB3/ASTE-6Z6KB3_R0_EN.pdf on Nov. 10, 2014.

Bit Rock Supply, Roofers World Ladder Mount. Obtained from https://www.bigrocksupply.com/store/p/8580-Roofers-World-Ladder-Mount.aspx, on Nov. 10, 2014.

Houzz, MWE—Hook Ladder, available as early as Feb. 2013. Obtained from http://www.houzz.com/photos/1877868/MWE-Hook-Ladder-KLASSIK-modern-living-room-vancouver, on Nov. 10, 2014.

Lansford Acess Ltd, Industrial Alloy Shelf Ladders, 2013. Obtained from http://www.ladders-999.co.uk/downloads/ShelfLadders2013.pdf on Nov. 10, 2014.

Moss et al, U.S. Appl. No. 61/879,506, 28 pages, filed Sep. 18, 2013.

PCT International Search Report for PCT International Patent Application No. PCT/US2013/063927, dated Jan. 16, 2014.

* cited by examiner

LADDER SECURING APPARATUSES, LADDERS INCORPORATING SAME AND RELATED METHODS

CROSS-REFERENCE TO RELATED APPLICATIONS

The present application is a division of U.S. patent application Ser. No. 14/049,927, filed on Oct. 9, 2013, issued as U.S. Pat. No. 9,404,306 on Aug. 2, 2016, which claims the benefit of U.S. Provisional Patent Application No. 61/711,632 filed on Oct. 9, 2012, and U.S. Provisional Patent Application No. 61/879,508, filed Sep. 18, 2013, the disclosures of each of which are incorporated by reference herein in their entireties.

TECHNICAL FIELD

The present invention relates generally to ladders and, more particularly, to components and features for securing a ladder in a stable working condition as well as related methods.

BACKGROUND

Ladders are conventionally utilized to provide a user thereof with improved access to elevated locations that might otherwise be inaccessible. Ladders come in many shapes and sizes, such as straight ladders, straight extension ladders, stepladders, and combination step and extension ladders. So-called combination ladders may incorporate, in a single ladder, many of the benefits of multiple ladder designs.

Ladders known as straight ladders or extension ladders are ladders that are conventionally not self-supporting but, rather, are positioned against an elevated surface, such as a wall or the edge of a roof, to support the ladder at a desired angle. A user then ascends the ladder to obtain access to an elevated area, such as access to an upper area of the wall or access to a ceiling or roof A pair of feet or pads, each being coupled to the bottom of an associated rail of the ladder, are conventionally used to engage the ground or some other supporting surface.

In certain industries, such as in the telecommunications industry, ladders are used to access overhead cables or utility lines (e.g., cables or wires used for telephones, cable television, etc). In such cases, the ladders are sometimes supported at their upper ends by a utility pole or other vertical structure. In some situations, the upper end of the ladder is actually supported by a utility line extending generally horizontally between adjacent utility poles or towers. In such cases, the ladders have conventionally been fitted with "cable hooks" or "strand hooks" which are attached to the top of the ladder and simply hook over the top of the utility cable. The top of the ladder, thus, rests against and is supported by the horizontally extending utility cable. However, while the cable hooks generally engage the utility cable to provide support to the ladder, if the ladder shifts or tilts relative to utility cable (e.g., because of unstable ground or because of the user of the ladder leaning out to far to the side and causing the loading on the ladder to become unbalanced), one or both of the cable hooks may disengage the utility cable such that the ladder loses support and stability. This obviously creates a dangerous situation for the user of the ladder.

Some efforts have been made to provide an engagement device that provides additional security over traditional cable hooks. For example, U.S. Pat. No. 7,219,766 issued to Deuer on May 22, 2007 (the disclosure of which is incorporated by reference herein in its entirety), describes a "mid-span fall protection system" for ladders. The Deuer patent describes cable hooks, with one of the cable hooks having a latch member pivotally coupled therewith. The latch functions in conjunction with the cable hook, similar to a gate of a carabineer. When a utility member pushes upward against the latch member, the latch member is displaced permitting the utility cable to pass by. The latch member then closes (being biased by a spring toward the closed position) to capture the utility cable in an area defined by the cable hook and the latch. When it is desired to release the utility cable, a user pulls on a line tethered to the latch member to keep the latch member open while lifting the ladder to displace the cable hooks away from the utility cable. In another example, U.S. Pat. No. 5,054,581 issued to Henson on Oct. 8, 1991 (the disclosure of which is incorporated by reference herein in its entirety) describes a device that attaches to two vertically adjacent rungs of a ladder and then provides a single point attachment to a utility cable.

Also, recognizing the potential for instability in ladders in various circumstances (such as the above mentioned "shifting" of the ladder), and in an effort to improve safety of ladders generally, some efforts have been made to provide a safety line for coupling with a user's harness to help secure a user to the ladder in case of an accidental slip or fall. For example, the Deuer patent discloses a rope that is coupled to a cross-member extending between the two side rails of the ladder. An "auto-latching/locking" mechanism is coupled with the rope which requires manual release for removal. Such an auto-latching mechanism is described in U.S. Pat. No. 5,855,251 issued to Deuer on Jan. 5, 1999 (the disclosure of which is incorporated by reference herein in its entirety).

However, such proposed solutions have not necessarily proved to be entirely successful and there is a continuing desire in the industry to provide improved functionality of ladders while also improving the safety and stability of such ladders.

SUMMARY

The present invention relates to ladders and, more particularly, various configurations of ladders, as well as to methods relating to the use and manufacture of ladders.

In one embodiment, a ladder is provided comprising a first pair of spaced apart rails and a plurality of rungs extending between and coupled to the first pair of spaced apart rails. A pair of hooks are located such that each hook is positioned adjacent and upper end of an associated rail. A securing apparatus is coupled adjacent the upper end of the first pair of spaced apart rails. The securing apparatus includes a pair of spaced apart engaging members and a cross-member coupled therebetween. Each of the engagement members is pivotally coupled with an associated rail of the first pair of spaced apart rails. In one embodiment, the securing apparatus lacks any biasing members (e.g., springs or actuators) or locking members.

In one embodiment, each engaging member is associated with one of the pair of hooks and, upon application of force to a cup portion of the engagement member by an overhead line, pivots to cooperatively encircle the overhead line with the engagement member and its associated hook. The cup portion of the engagement members may include a slip-resistant surface.

The ladder may be configured as an extension ladder and include a second pair of rails and another plurality of rungs extending between and coupled to the second pair of spaced apart rails, wherein the second pair of rails are slidably coupled with the first pair of rails.

In one embodiment, the ladder may further include a safety apparatus having a safety line and an attachment mechanism coupled therewith. The line may be coupled with an inertia locking mechanism. In one embodiment, the inertia locking mechanism may also include a retraction mechanism. In one particular embodiment, the safety line is coupled with a portion of the ladder and extends up and over the cross-member of the securing apparatus.

In accordance with another aspect of the invention, a ladder is provided that comprises a first pair of spaced apart rails, a plurality of rungs extending between and coupled to the first pair of spaced apart rails, and a safety apparatus including a safety line coupled with an inertia locking and retraction mechanism.

In accordance with another aspect of the present invention, a method of securing a ladder is provided. The method includes providing a ladder having a pair of space apart hooks and a pair of spaced apart engagement members, positioning the ladder such that a cup portion of each engagement member engages an overhead line, displacing the ladder relative to the overhead line to effect concurrent rotation of the engagement members, and encircling the overhead line at two spaced apart locations with the engagement members and the hooks.

In accordance with another embodiment, an apparatus is provided for securing a ladder to a vertical support structure. The apparatus includes a pair of spaced apart brackets, each bracket being configured for coupling with a component of a ladder, a pair of arms, each arm being pivotally coupled to an associated one of the pair of brackets and a strap coupled between the pair of arms and configured such that displacement of the strap effects rotation of the arms relative to their associated bracket.

In one embodiment, the apparatus may include a first ratcheting mechanism associated with a first arm of the pair of arms and a second ratcheting mechanism associated with a second arm of the pair of arms. The first and second ratcheting mechanisms may further be configured to permit rotation of the first and second arms towards one another, but selectively prohibit rotation of the first and second arms away from one another.

In accordance with another embodiment, a method of securing a ladder is provided. The method includes providing a ladder having a pair of arms pivotally coupled with the ladder and a flexible strap coupled with each of the pair of arms. The ladder is positioned such that a vertical support structure engages and displaces the flexible strap. The pair of arms are displaced inwardly toward each other responsive to the displacement of the flexible strap such that the pair of arms engage the vertical support structure.

In accordance with another embodiment, a ladder is provided comprising a first pair of spaced apart rails, a plurality of rungs extending between and coupled to the first pair of spaced apart rails, and at least one hook. The at least one hood is positioned adjacent an upper end of an associated rail of the first pair of spaced apart rails and is configured to pivot through an angle of approximately 90° from a first position to a second position wherein, when in the second position, the at least one hook is substantially within an envelope defined by the first pair of spaced apart rails. The ladder additionally includes a securing apparatus comprising at least one engaging member positioned adjacent the at least one hook and being pivotal relative to the at least one hook.

It is noted that the embodiments described herein are not to be considered mutually exclusive of one another and that any feature, aspect or component of one embodiment described herein may be combined with other features, aspects or components of other embodiments.

BRIEF DESCRIPTION OF THE DRAWINGS

The foregoing and other advantages of the invention will become apparent upon reading the following detailed description and upon reference to the drawings in which.

DETAILED DESCRIPTION

Figure 1:
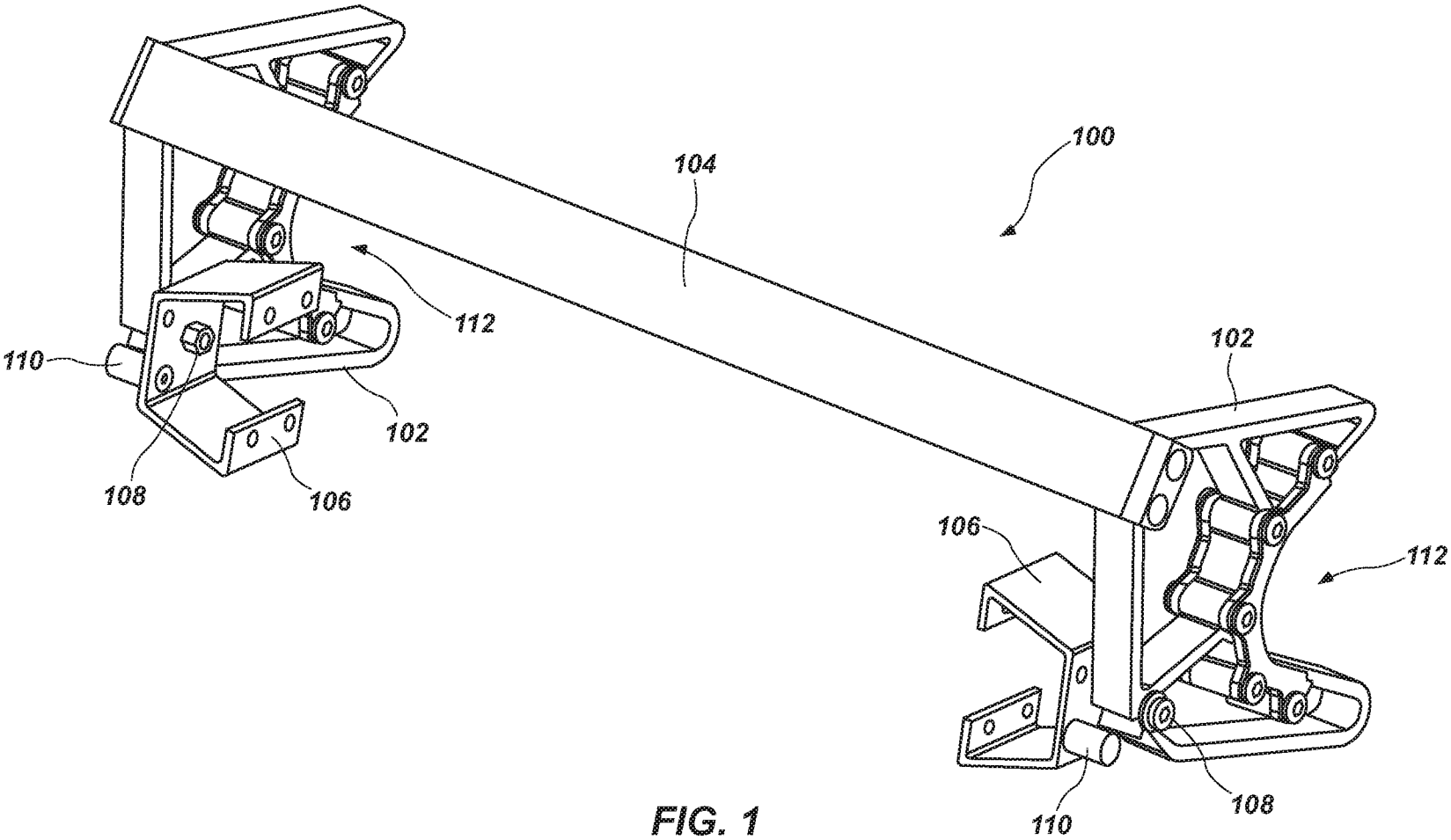
FIG. 1 is a front perspective view of an apparatus for use with a ladder according to an embodiment of the present invention.
Figure 2:
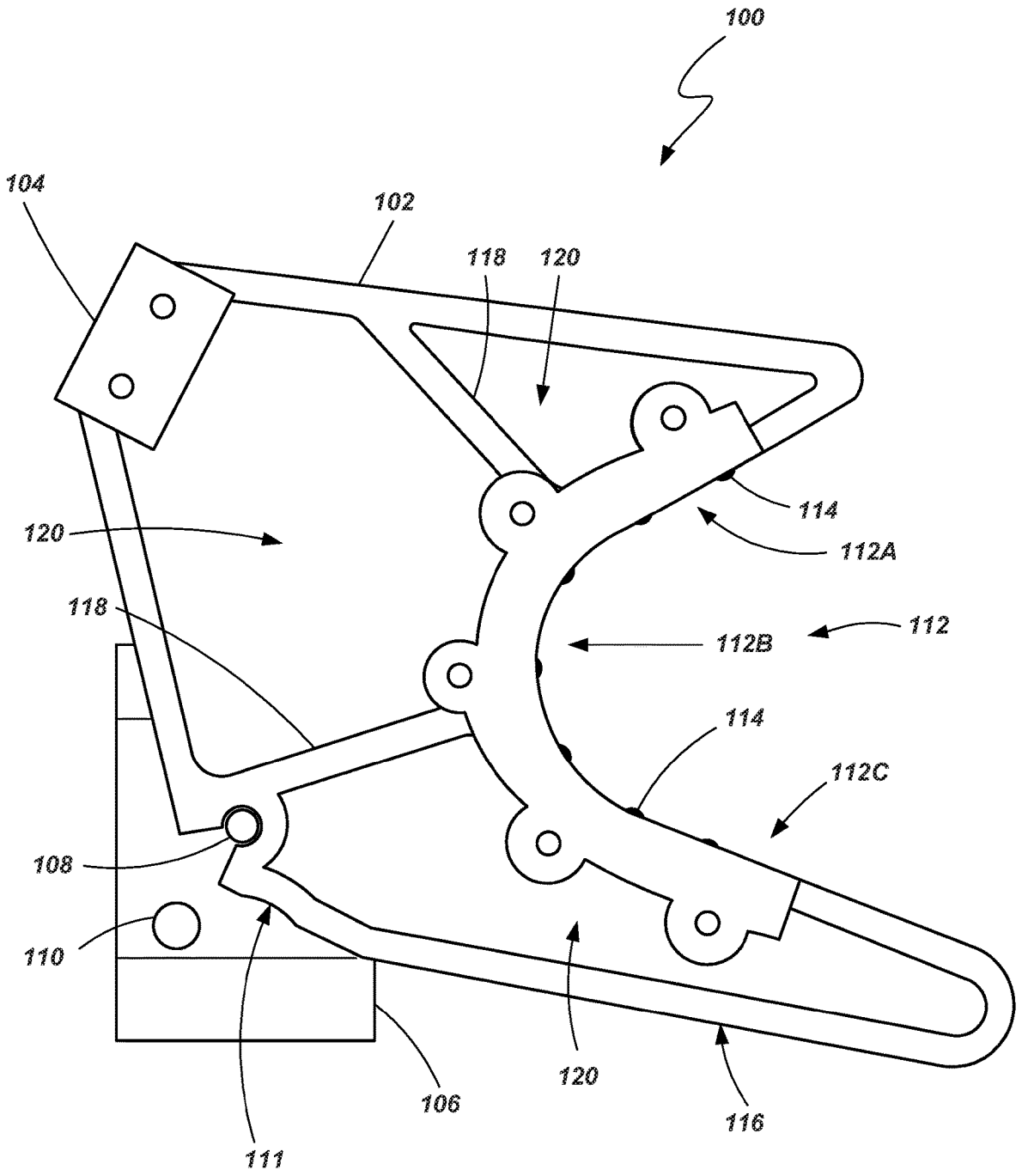
FIG. 2 is side view of the apparatus shown in FIG. 1.

Referring initially to FIGS. 1 and 2, a securing apparatus 100 is shown for use with a ladder when it is desired to support the ladder using a generally horizontally extending overhead line (e.g., a utility line such as used in the telecommunications industry). The apparatus 100 includes two spaced apart engagement members 102 that may be coupled together by a cross-member 104 which may include, for example, a bar or a plate member. While the distance that the engagement members are spaced from each other may be determined, at least in part, on the size of the ladder (e.g., the spacing of the rails from one another), in one example, the engagement members 102 may be spaced approximately 18 inches to 24 inches away from one another. Each of the engagement members 102 are pivotally coupled to an associated bracket 106 by way of a pin or shaft 108.

The brackets 106 are configured for attachment with associated rails of a ladder (e.g., an extension ladder) such as by way of a rivet, a screw, bolt or other appropriate means (including adhesives, welding or other joining methods depending on the materials being used). In other embodiments, the brackets 106 may be integrally formed in the rails of the ladder or the pin/shaft 108 may be coupled directly to the rails of the ladder. Additionally, while shown as a simple pin or shaft 108, the pivoting arrangement between the engagement member 102 and its associated bracket 106 (or ladder rail) may include any of a variety of known bearing mechanisms.

A stop member 110 may be provided in association with either or both brackets 108 to prevent the engagement members 102 from rotating beyond a desired point. For example, referring specifically to FIG. 2, if the apparatus were coupled with a ladder (as will be discussed in further detail below), absent other forces being applied to the engagement members 102, gravity would cause the engagement members 102 to rotate clockwise about the pin or shaft 108 (based on the orientation shown in FIG. 2) until a portion of the engagement member 102 (e.g., an abutment surface 111) abuts the stop member 110. The stop member 110, in conjunction with gravity, thus, holds engagement member 102 in a desired position relative to the side rails of a ladder by preventing it from rotating further. Other stop members may additionally, or alternatively, be employed if desired. For example, in another embodiment, the cross member 104 may be configured to abut a top portion of the rails of a ladder to impede further rotation and to place the mechanism in a desired position for engagement with a utility line or other support member.

The engagement members 102 include a cup portion 112 having an upper portion 112A, a central portion 112B and a lower portion 112B. In the embodiment shown, the central portion 112B includes an arcuate section that extends through an arc angle of greater than 90°. In other embodiments, the arcuate section may be replaced by an angle (or a series of angles) such that the upper portion 112A lies at an acute angle relative to the lower portion 112C. In another embodiment, the upper portion 112A and the lower portion 112C may be configured to extend substantially parallel to each other. The cup portion 112 is configured to receive a portion of an overhead line therein (as will be further discussed below). The surface of the cup portion 112 may be textured and may be formed of, or coated with, a material to provide frictional resistance when it engages an overhead line. For example, the cup portion 112 may be covered with a rubber material having a plurality of ridges, raised sections or other surface features 114 that are configured to help frictionally engage or grip a portion of a utility cable or overhead line. Additionally, the material covering of the cup portion 112 may assist in protecting the overhead line from damage when being engaged by the apparatus 100.

The apparatus 100 may be formed from a variety of materials using various methods of manufacturing as will be appreciated by those of ordinary skill in the art. For example, the engagement members 102, the cross-member 104 and the brackets 106 may be formed of metal, metal alloys, plastic materials, composite materials or various combinations of such materials. Such components may be formed by various techniques including machining, molding, stamping, forging, extruding and so forth. In one particular embodiment, the engagement members 102 are formed of an aluminum material with the cross-member 104 with the brackets being formed of a metal or metal alloy. In another embodiment, the engagement members 102 may be formed of a plastic material. As seen in FIGS. 1 and 2, the engagement members 102 may be formed to include a peripheral wall member 116 and one or more inner structurally reinforcing members 118 defining various openings or cells 120. Such a configuration provides appropriate strength for the apparatus while reducing the weight of the apparatus significantly. Of course, other structural configurations may be used in forming the engagement members 102 as will be appreciated by those of ordinary skill in the art.

It is noted that the apparatus 100, according to the embodiment shown in FIGS. 1 and 2, does not include any springs, biasing members, actuators or locking mechanisms. Rather, the apparatus 100 utilizes gravity in conjunction with the positioning of the ladder by a user thereof to engage, and maintain such engagement with, an overhead line. Additionally, as will be seen with further discussion below, no locks or actuators are required to be activated by a user either while on the ladder, or while standing at the base of the ladder, to release the apparatus from an overhead line. Rather, all that a user has to do to disengage the over head line is to lift the ladder as one would normally do with conventional cable hooks.

Figure 3:
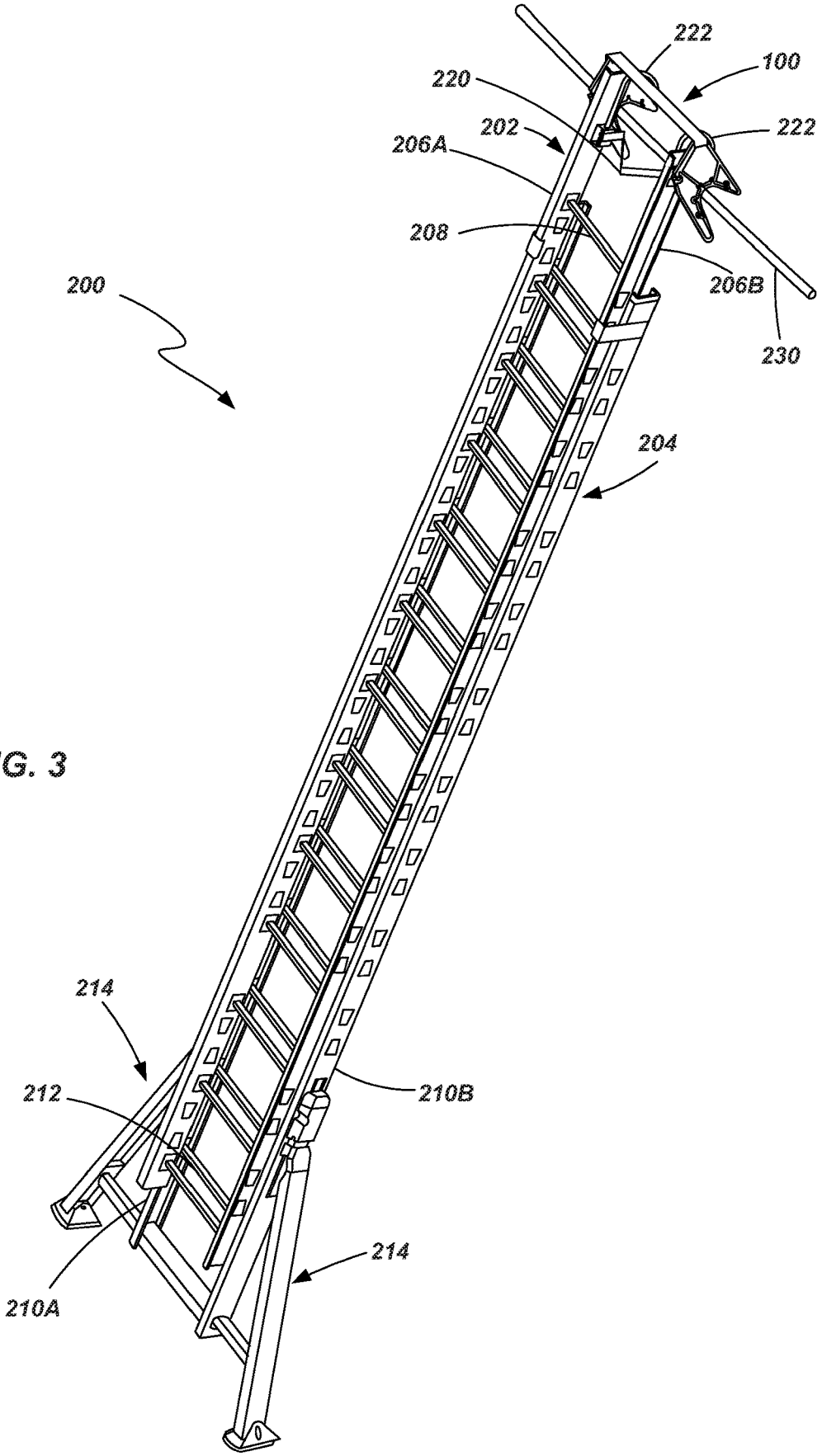
FIG. 3 is a perspective view of a ladder having the apparatus of FIG. 1 placed in a first position in accordance with an embodiment of the present invention.
Figure 4:
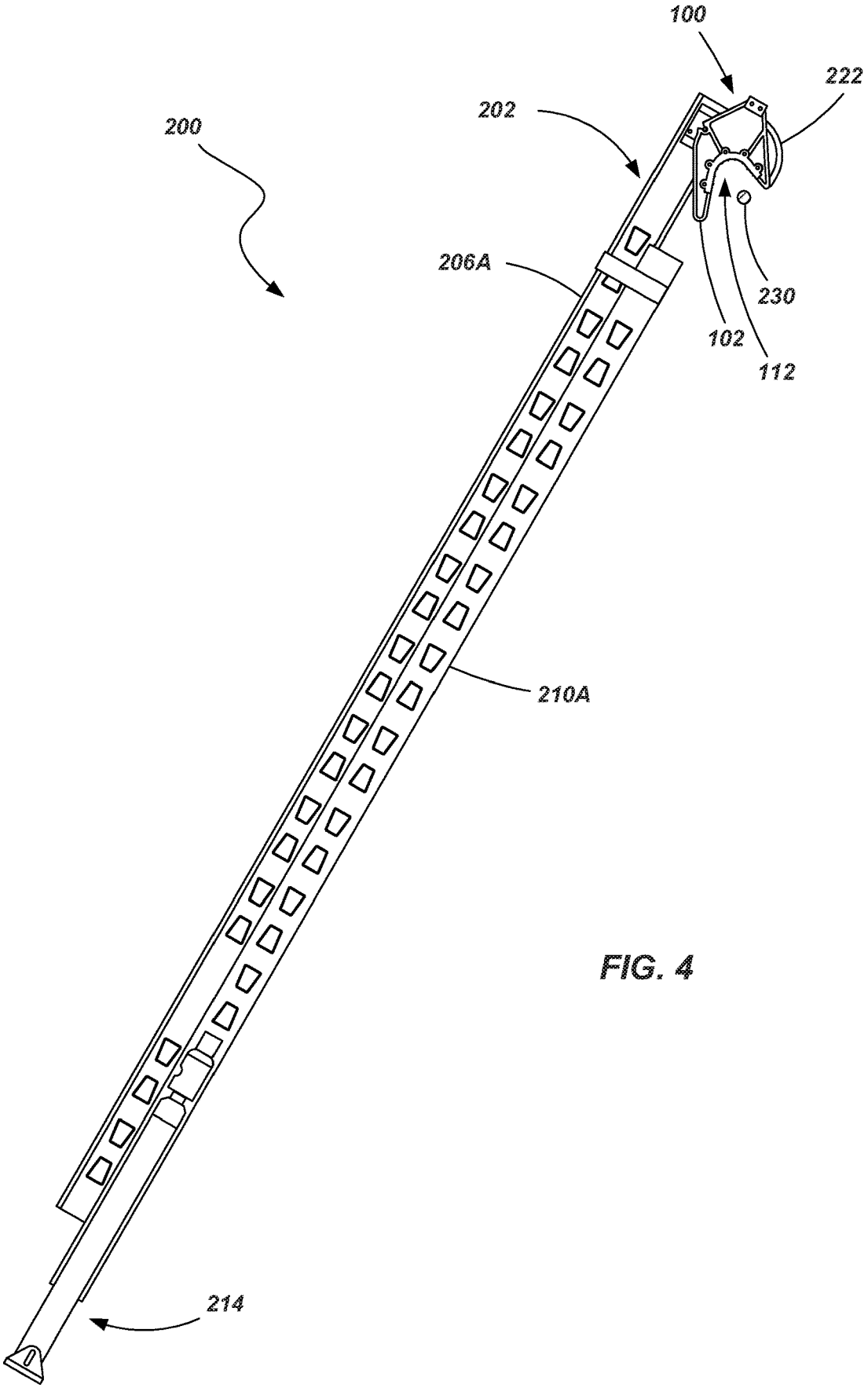
FIG. 4 is a side view of the ladder shown in FIG. 3.

Referring now to FIGS. 3 and 4, a ladder 200 is shown that includes a securing apparatus 100 such as described above. The ladder 200 is configured as an extension ladder and includes a first assembly 202 and a second assembly 204 slidably coupled with the first assembly. The first assembly 202 includes a pair of spaced apart rails 206A and 206B with a plurality of rungs 208 extending between, and coupled to, the rails 206A and 206B. Similarly, the second assembly 204 includes a pair of spaced apart rails 210A and 210B with a plurality of rungs 212 extending between, and coupled to, the rails 210A and 210B. While not specifically shown in the drawings, one or more mechanisms are associated with the first and second assemblies 202 and 204 to enable selective positioning of the first assembly 202 relative to the second assembly 204. This enables the ladder 200 to assume a variety of lengths (or, more specifically, heights when in an intended operating orientation) by sliding the first assembly 202 relative to the second assembly 204 and locking the two assemblies in a desired position relative to one another. By selectively adjusting the two rail assemblies 202 and 204 relative to each other, a ladder can be extended in length to nearly double its collapsed or shortest state, as will be appreciated by those of ordinary skill in the art. By way of example, a rung lock apparatus is described in U.S. Pat. No. 5,429,207 to Frank et al., issued Jul. 4, 1995, the disclosure of which is incorporated by reference herein in its entirety.

In many conventional extension ladders, feet members may be coupled to the lower ends of the rails 210A and 210B to support the ladder on the ground or other surface. Such a configuration is contemplated as being used in other embodiments of the present invention. In the specific embodiment shown, adjustable support members 214 are coupled with the second assembly 204 to provide increased lateral stability as well as the ability to adjust the ladder for support on uneven surfaces. An example of such adjusting members is described in U.S. Patent Application Publication No. US 20100300805 (Application Ser. No. 12/714,313) published on Dec. 2, 2010, the disclosure of which is incorporated by reference herein in its entirety. Again, as noted above, the present invention is not limited to particular types of ladders and may be implemented in conjunction with conventional extension ladders, straight ladders or even combination ladders if desired.

The ladder 200 further includes a brace member, referred to as a V-bar 220, located at the upper end of the first assembly 202 which extends between and is coupled to the rails 206A and 206B of the first assembly 202. The V-bar 220 is shaped to engage a vertical structure, such as a utility pole, and be supported thereby. While not specifically shown, the inner surface of the V-bar 220 (the surface that will engage a support structure) may be textured, coated, include protruding members (e.g., barbs or prongs), include an undulating surface, or otherwise configured to provide slip resistance when positioned against a vertical supporting structure such as a utility pole.

Figure 3A:
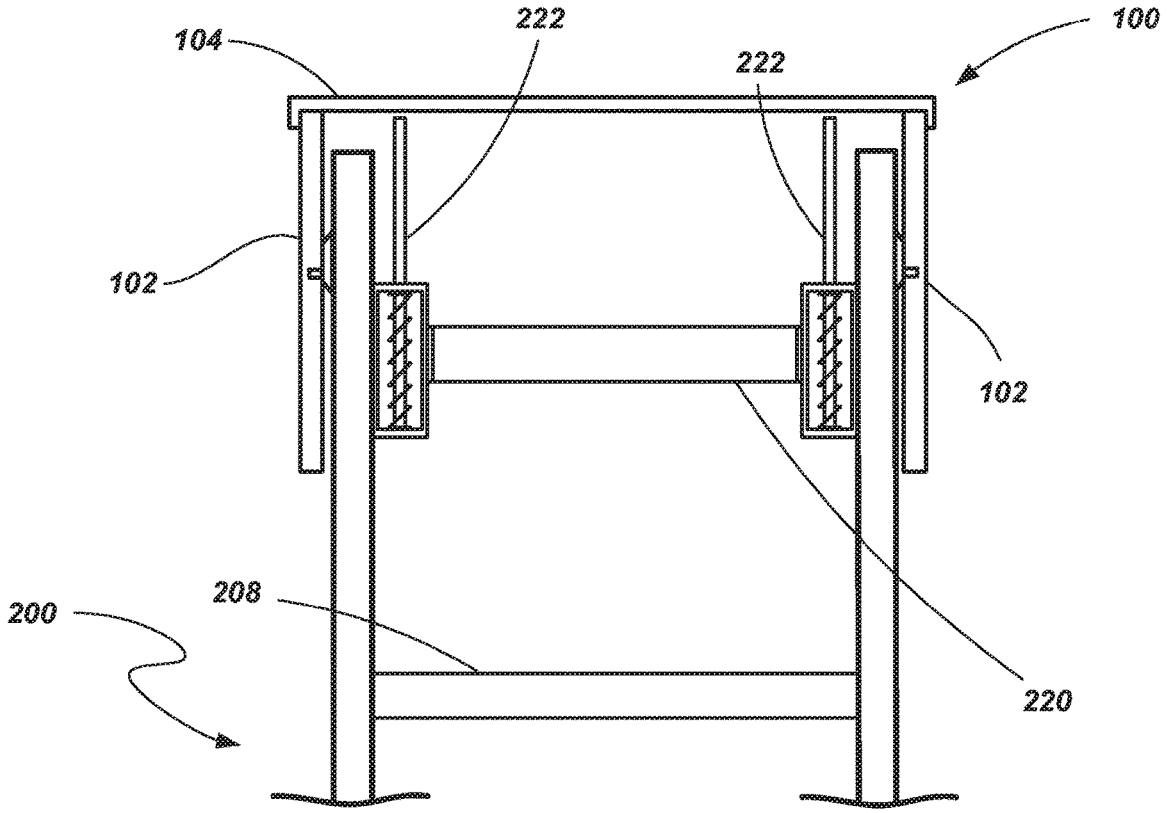
FIGS. 3A and 3B depict a front view of an upper portion of the ladder shown in FIG. 3 with certain components rotated from a first position (FIG. 3A) to a second position (FIG. 3B)
Figure 3B:
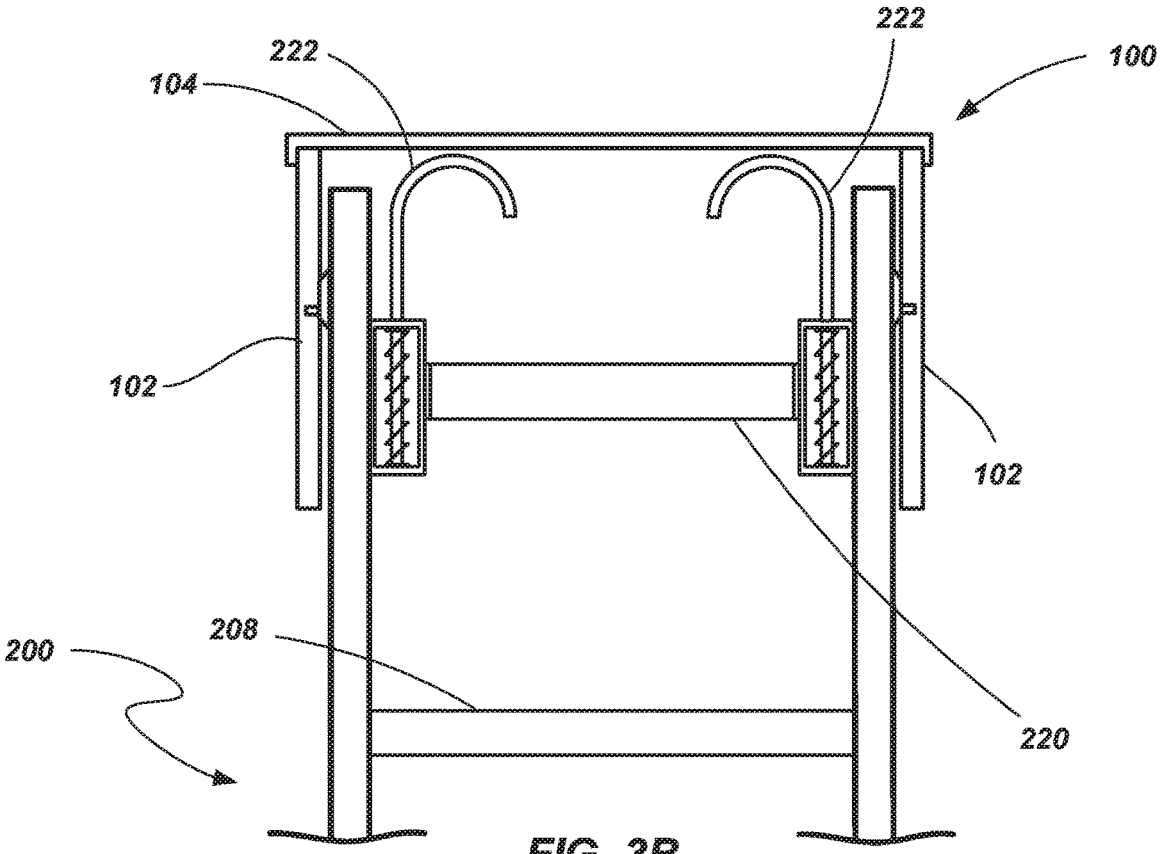

Additionally, the ladder 200 includes a pair of hooks 222 (e.g., cable hooks), one associated with each rail 206A and 206B of the first assembly 202. The hooks 222 are configured to be positioned over and rest down upon an overhead line. As will be appreciated by those of ordinary skill in the art, the hooks 222 may be configured to be rotated from the position shown to a "stored" position so that they are largely placed within the envelope or volume defined by the rails 206A and 206B of the first assembly. Thus, for example, the hooks 222 may be selectively positioned in a first position with the hook ends extending to the backside of the ladder (as shown in the drawings—see, e.g., FIG. 3A) or in a second position where the hook ends are positioned between the two rails 206A and 206B, a rotation of approximately 90°(see, e.g., FIG. 3B).

Figure 5A:
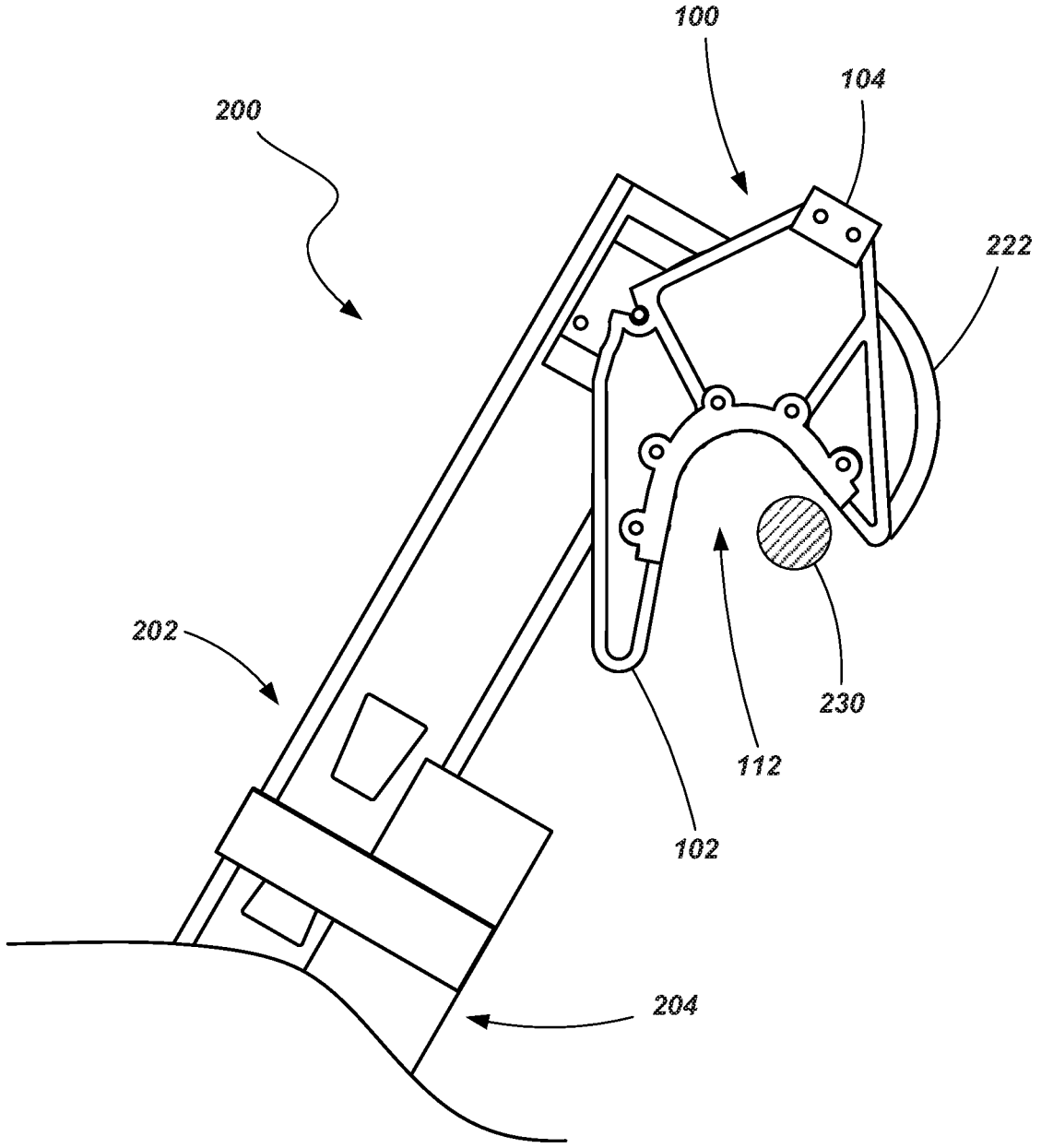
FIGS. 5A-5C are side views of a portion of the ladder shown in FIG. 3 with a component in various positions or stages or use.
Figure 5B:
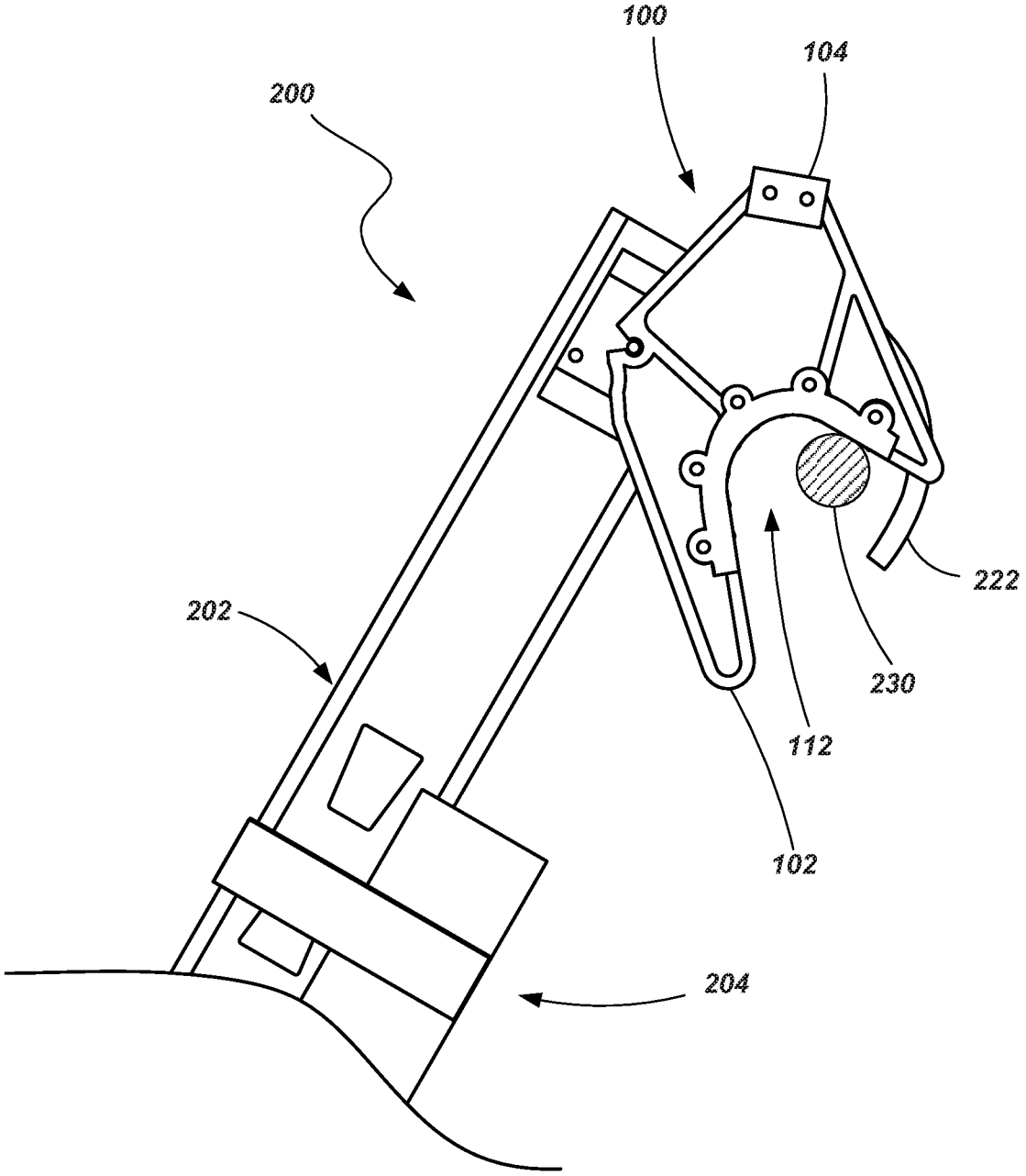
Figure 5C:
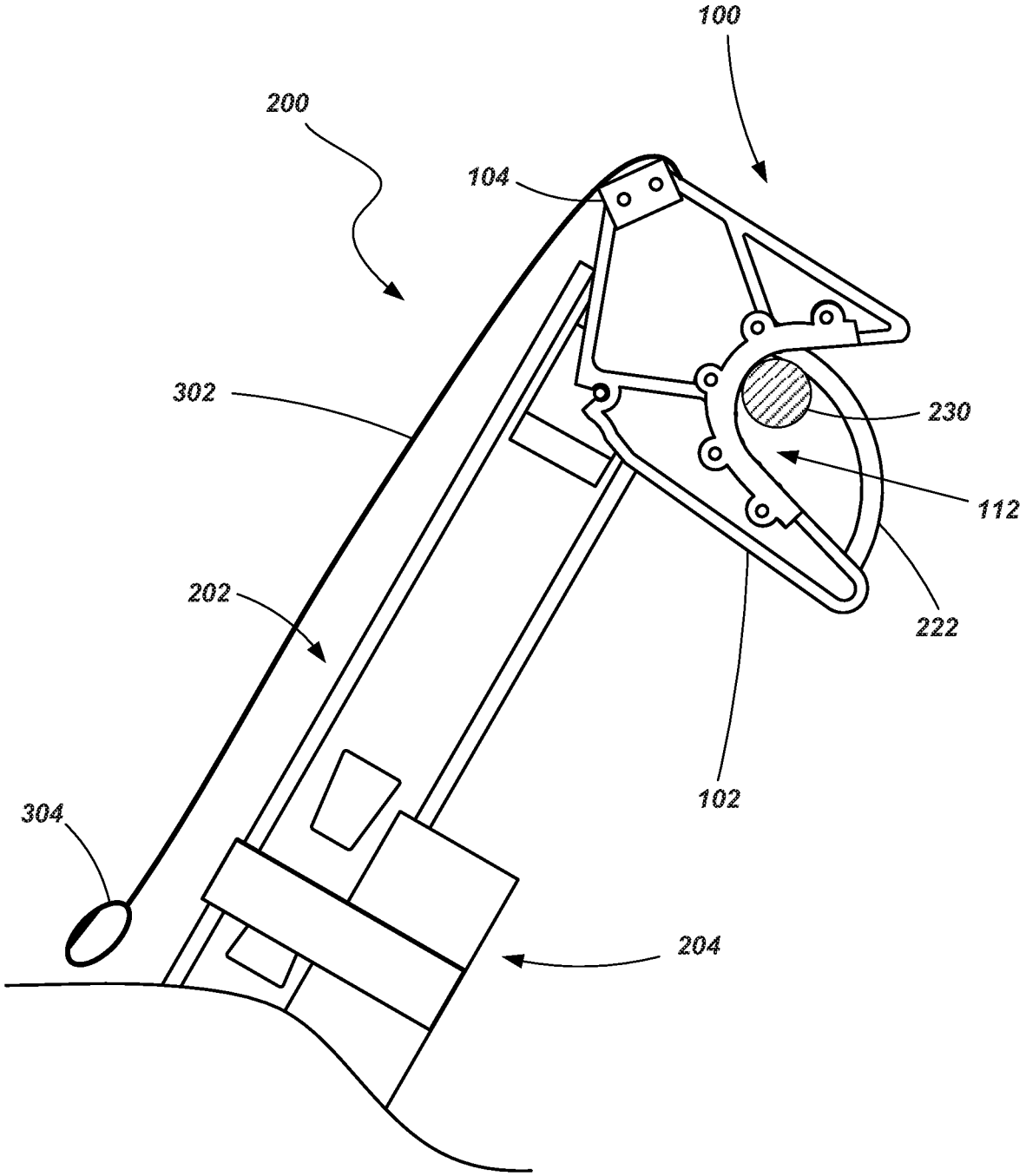

As shown in FIGS. 3 and 4, the securing apparatus 100 is coupled to first assembly 202 and is in a first position prior to engagement of an overhead line 230. When in this position, the cup portion 112 of the apparatus 100 and the open ends of the hooks 222 are positioned above the overhead line 230, ready for engagement therewith. This is also shown, in larger side view, in FIG. 5A. As shown in FIG. 5B, by lowering the upper portion of the ladder 200, the engagement members 102 are positioned to contact the overhead line 230, or, more specifically, the cup portions 112 of the engagement members 102 contact the overhead line 230. This results in the engagement members 102 (and associated cross member 104) rotating about the shaft/pin 108 as the hooks 222 begin to descend over the overhead line 230. As shown in FIG. 5C, the upper portion of the ladder 200 is lowered to point where the overhead line 230 is captured within the hooks 222. At the same time, the engagement members 102 continue to rotate, by virtue of the overhead line "pushing up" against the upper portion 112A (or even the middle portion 112B) of the engagement member's cup portion 112. When the hook 222 is engaging the overhead line—supporting the upper end of the ladder 200 in this position—the engagement member 102 is positioned such that the overhead line is encircled by the combination of the hook 222 and the cup portion 112 of the engagement member 102. It is noted that the lower portion 112C of the engagement member's cup portion 112 extends towards the outer end of the hook 222, across the otherwise open area of the hook 222, to help form this encircling structure.

Figure 6:
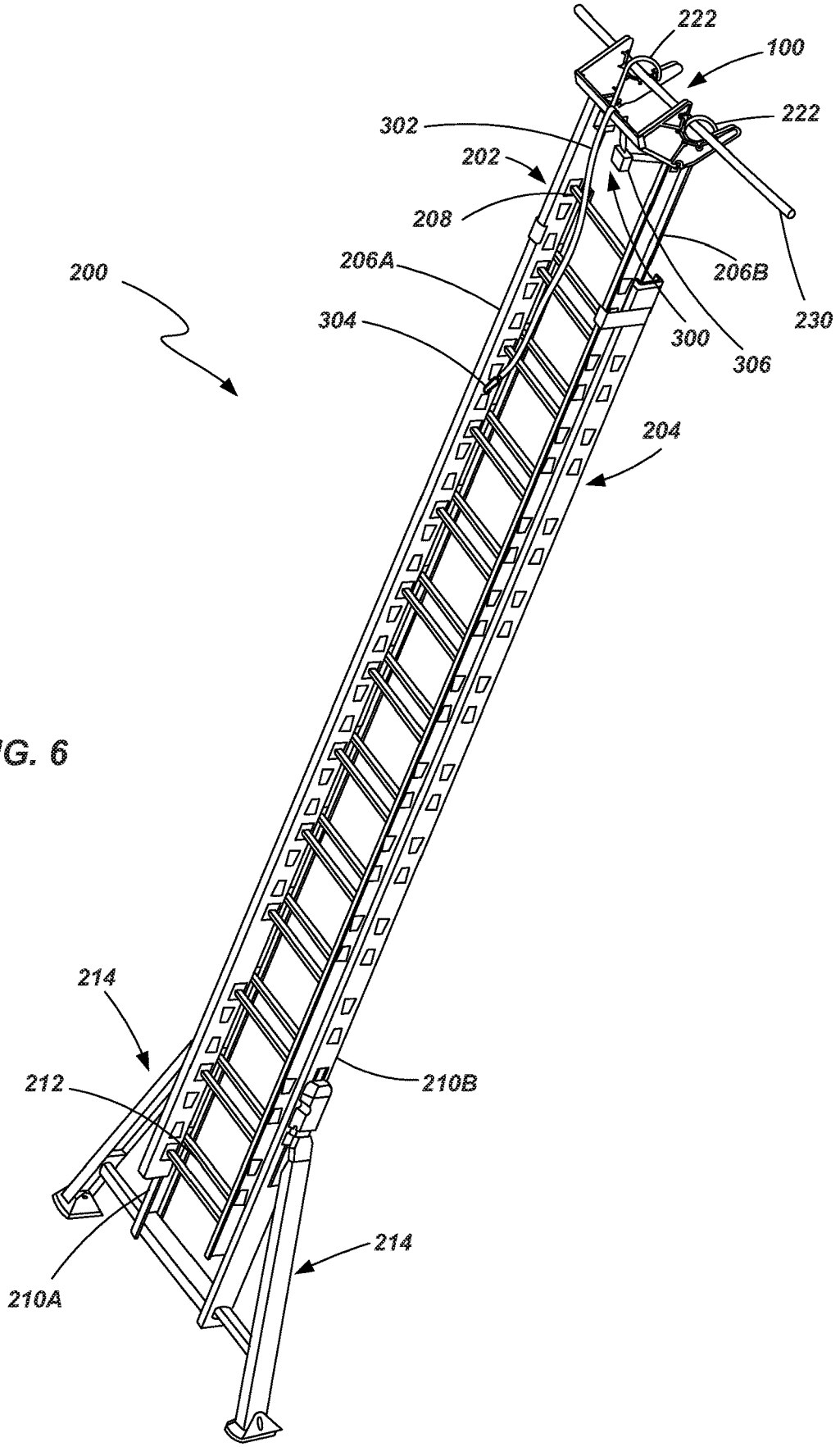
FIG. 6 is a perspective view of the ladder shown in FIG. 3 with the apparatus having been displaced to a second position.
Figure 7:
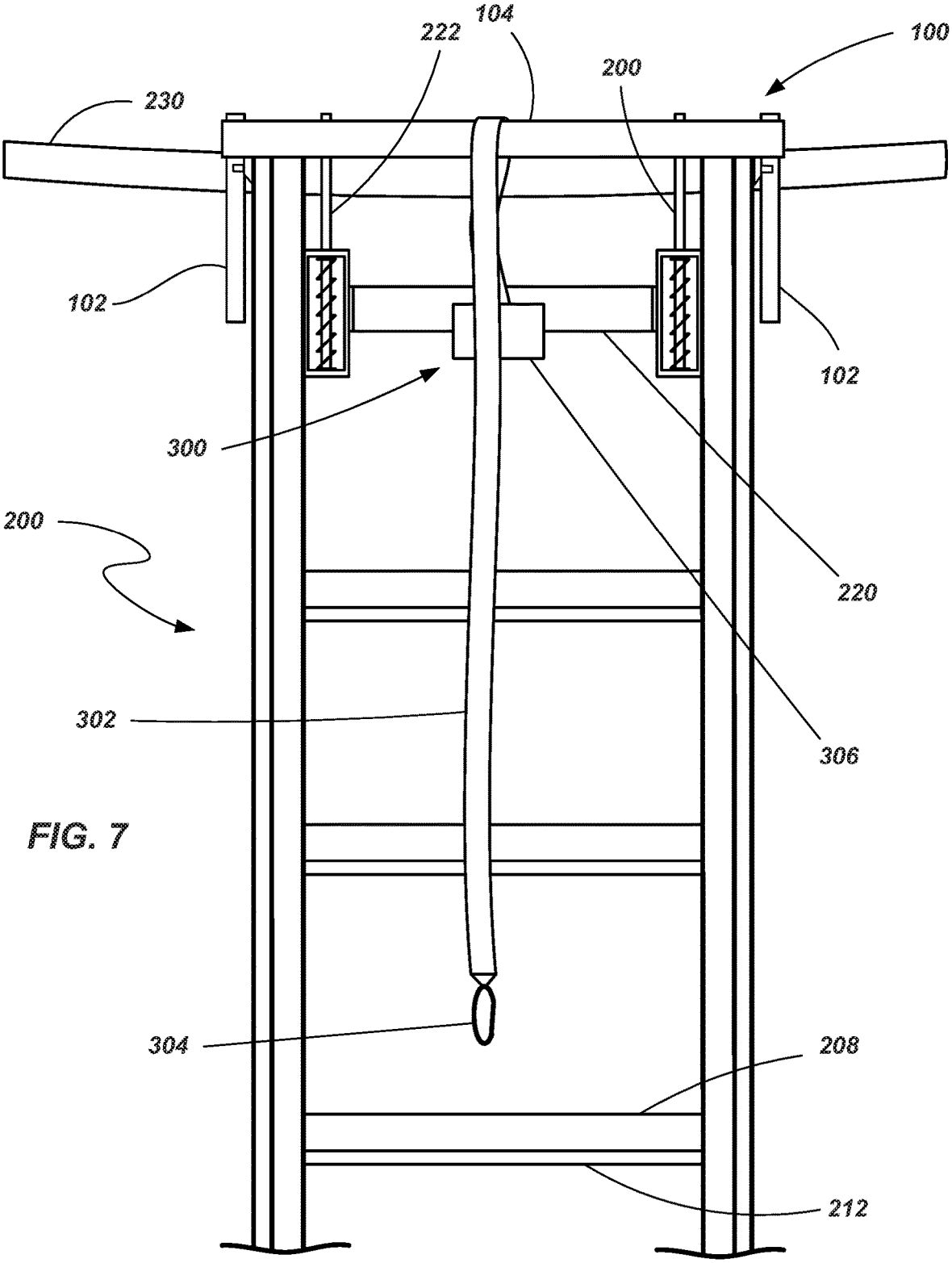
FIG. 7 is a front view of a portion of the ladder shown in FIG. 3.

Thus, as shown in FIGS. 5C, 6 and 7, the overhead line 230 is encircled at two, spaced apart locations by structures defined in part by the hooks 222 and in part by the engagement members 102. The securement of the ladder 200 to the overhead line 230 remains in place by reason of gravity and the cooperative positioning of the hooks 222 with the engagement members 102. As long as a user is on the ladder 200, the additional weight of the user, combined with the weight of the ladder, continues to keep the ladder secured with the combined weight pulling down on the overhead line 230 through the hooks 222, the overhead line 230 in turn pushing up against the upper and/or middle portion 112A and 112B of the engagement member's cup portion 112 to keep the engagement members 102 rotated in the position shown in FIGS. 5C, 6 and 7 and keeping the overhead line encircled. Even if the ladder 200 were to somehow shift laterally (e.g., because the user is leaning over to one side of the other), because the two engagement members 102 are coupled together by the cross-member, both engagement members 102 will remain in position encircling the overhead line 230. In prior art ladders which, for example, only used hooks in an effort to secure the ladder, shifting of the ladder would potentially enable one of the hooks to disengage the overhead line such that the ladder was only supported by a single hook, permitting the ladder to spin or twist in a dangerous manner.

It is noted, however, that the cross-member need not be used in every embodiment. Indeed, the cross-member may be eliminated and the engagement members 102 may operate independent of one another (although each would continue to operate cooperatively with its associated hook 222). It is additionally noted that, while function of the engagement members 102 and hooks 222 is discussed in regard to the example of a "cable" or utility line, that the securing apparatus 100 may be utilized with other horizontal support members, including, for example, rigid bars or poles, such as may be coupled to a wall, roof line or other structure.

To remove the ladder from the supporting overhead line 230, a user merely needs to lift the ladder 200, or more correctly, displace the upper portion of the ladder 200 upwards until the hooks 222 are above the overhead line 230, and then remove the ladder 200. As the upper portion of the ladder 200 is displaced upwards, gravity causes the engagement members 102 to rotate enabling the overhead line 230 to escape from the cup portion 112. In other words, starting from the position shown in FIG. 5C, as the upper portion of the ladder 200 is displaced upwards, the engagement member 102 would rotate clockwise (based on the orientation shown in FIG. 5C), due to gravity, to the positions shown first in FIG. 5B and then in FIG. 5A, releasing the overhead line 230.

Thus, the present securing apparatus does not require that any locks or actuating mechanisms be attended to prior to setting the ladder up against the overhead line or when the ladder is to be removed from the site. Similarly, there are no locks that need to be attended to after ascension of the ladder or that need to be unlocked prior to descending the ladder—such configurations presenting an operational safety hazard since the ladder is "unlocked" or unsecured for a brief moment while the user ascends or descends the ladder.

It is noted that the embodiments discussed above depict the engagement members 102 being positioned outside the rails 206A and 206B of the ladder 200. In other embodiments, the engagement members could be positioned inwardly of the rails 206A and 206B and, even, inwardly of the hooks 222 if desired.

With continued reference to FIGS. 5C, 6 and 7, a safety apparatus 300 is shown in accordance with another embodiment of the present invention. The safety apparatus 300 includes a cable, rope, chain, strap or other elongated, flexible member (referred to generally as a line 302) coupled to the first assembly 202 of the ladder. An attachment mechanism 304 such as a hook or carabineer is attached to one end of the line 302 for coupling to, for example, a harness or safety belt of a user. The other end of the line 302 may be coupled to a retraction and locking mechanism 306 which is coupled to, for example, the first assembly 202 (although in other embodiments, it may be attached to other components of the ladder 200 including direct attachment to the apparatus 100 if desired). In one example, the retraction and locking mechanism 306 may include a mechanism such as described in U.S. Pat. No. 3,917,189 to Bryll, the disclosure of which is incorporated by reference herein in its entirety. Another example of a retraction/locking mechanism includes the self-retracting line known as RL20G/2FT MightyLite available from Miller®, a Honeywell company.

Thus, a user may couple the line 302 to their harness or safety belt and, as they ascend the ladder 200, the line will automatically retract within the mechanism 306. Similarly, as the user descends the ladder 200 at a controlled pace, the mechanism will allow the line to pay out so that the user may reach the bottom of the ladder 200 without the line 302 "catching" or stopping the user's descent. However, if a user happens to slip or fall while coupled to the line 302, the mechanism will, by virtue of the quick acceleration of the line, lock the line and prevent it from paying out any further, keeping the user from falling a substantial distance.

It is noted that, in one embodiment (as shown in FIGS. 5C, 6 and 7), the line 302 may be coupled with the first assembly 202 such that it extends up and over the cross-member 104 of the securing apparatus 100. In such a configuration, if a user were to fall, the weight of the user would be applied to the cross-member 104 ensuring that the engagement members did not release an overhead line 230. In fact, the rotation of the engagement members 102 due to the application of such force would actually cause the engagement members 102 to more strongly grip the overhead line 230, ensuring that the ladder 200 did not disengage the overhead line while a user was regaining a stable position on the ladder 200. In other embodiments, the retraction mechanism 306 may be coupled directly to the securing apparatus 100 (e.g., to the cross-member 104), or various other arrangements may be used in coupling one or more of the various components of the safety apparatus 300 to the ladder 200, the securing apparatus 100, or to both. Of course, other safety lines may be used in a similar manner without a retraction mechanism.

Other embodiments of fall arrest systems may also be utilized in conjunction with the ladders and assemblies described herein. For example, a fall arrest system such as described in U.S. Provisional Patent Application No. 61/879,506, filed on Sep. 18, 2013, the disclosure of which is incorporated by reference herein in its entirety.

Figure 8A:
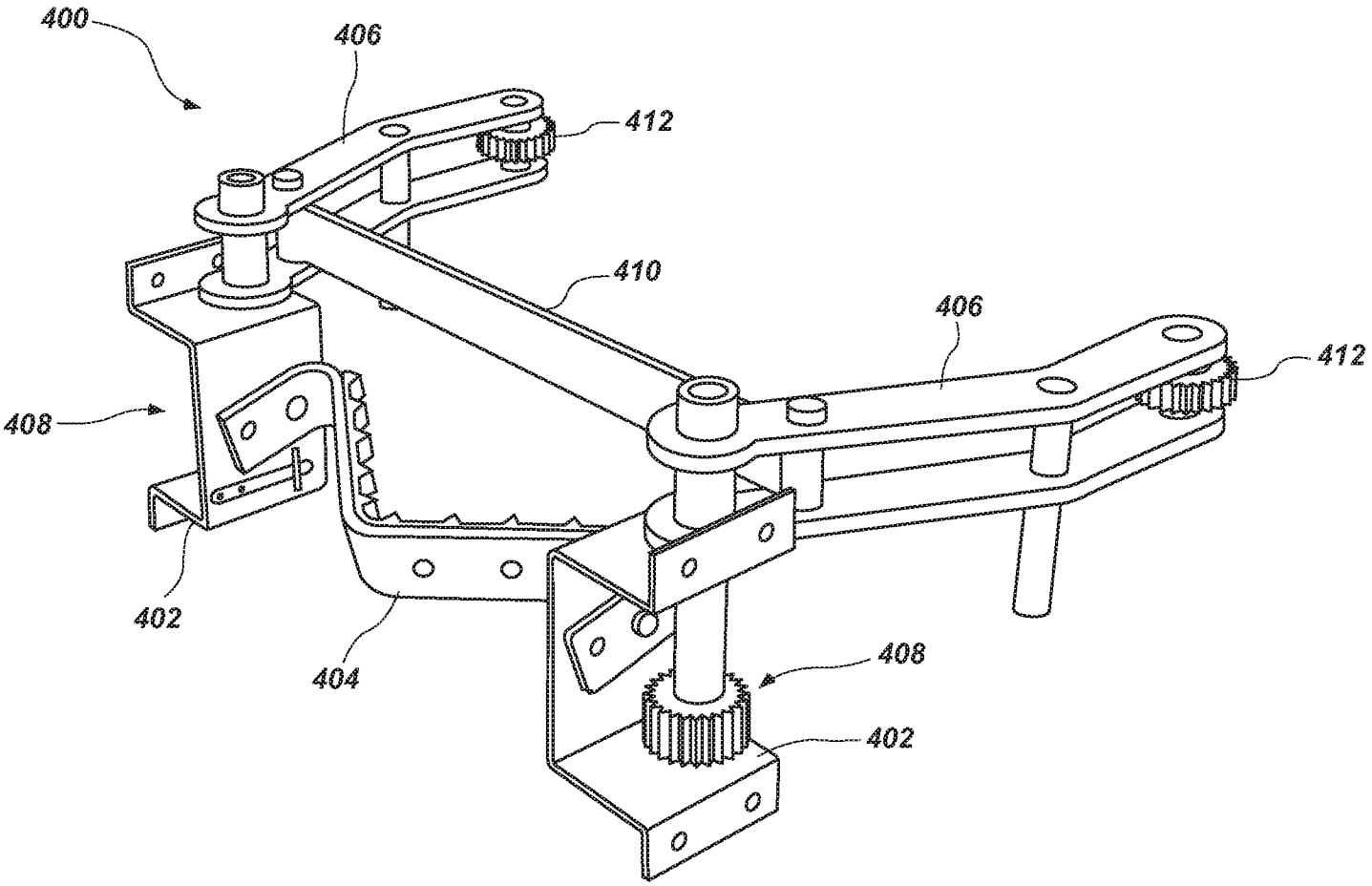
FIGS. 8A-8C show various views of a securing apparatus that may be used with a ladder in accordance with another embodiment of the invention.
Figure 8B:
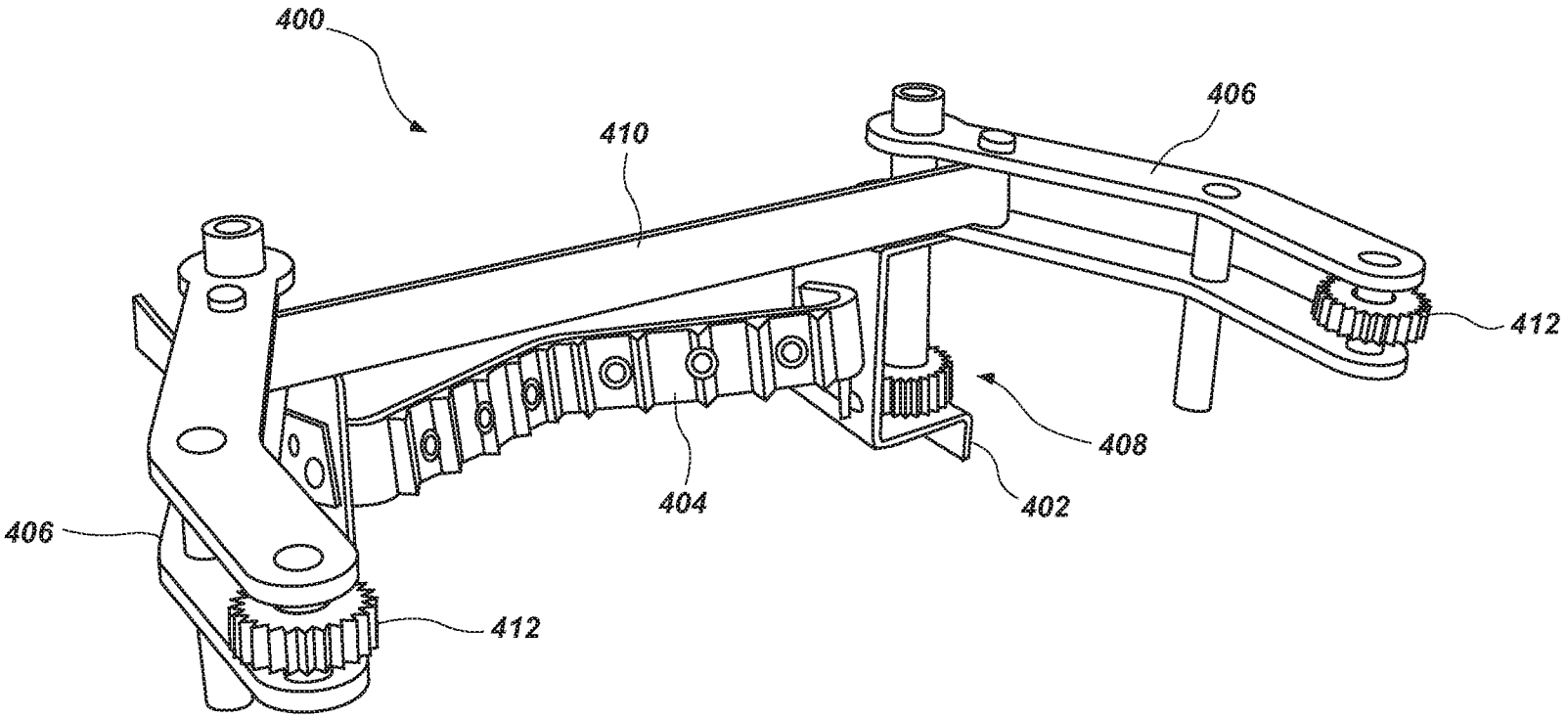
Figure 8C:
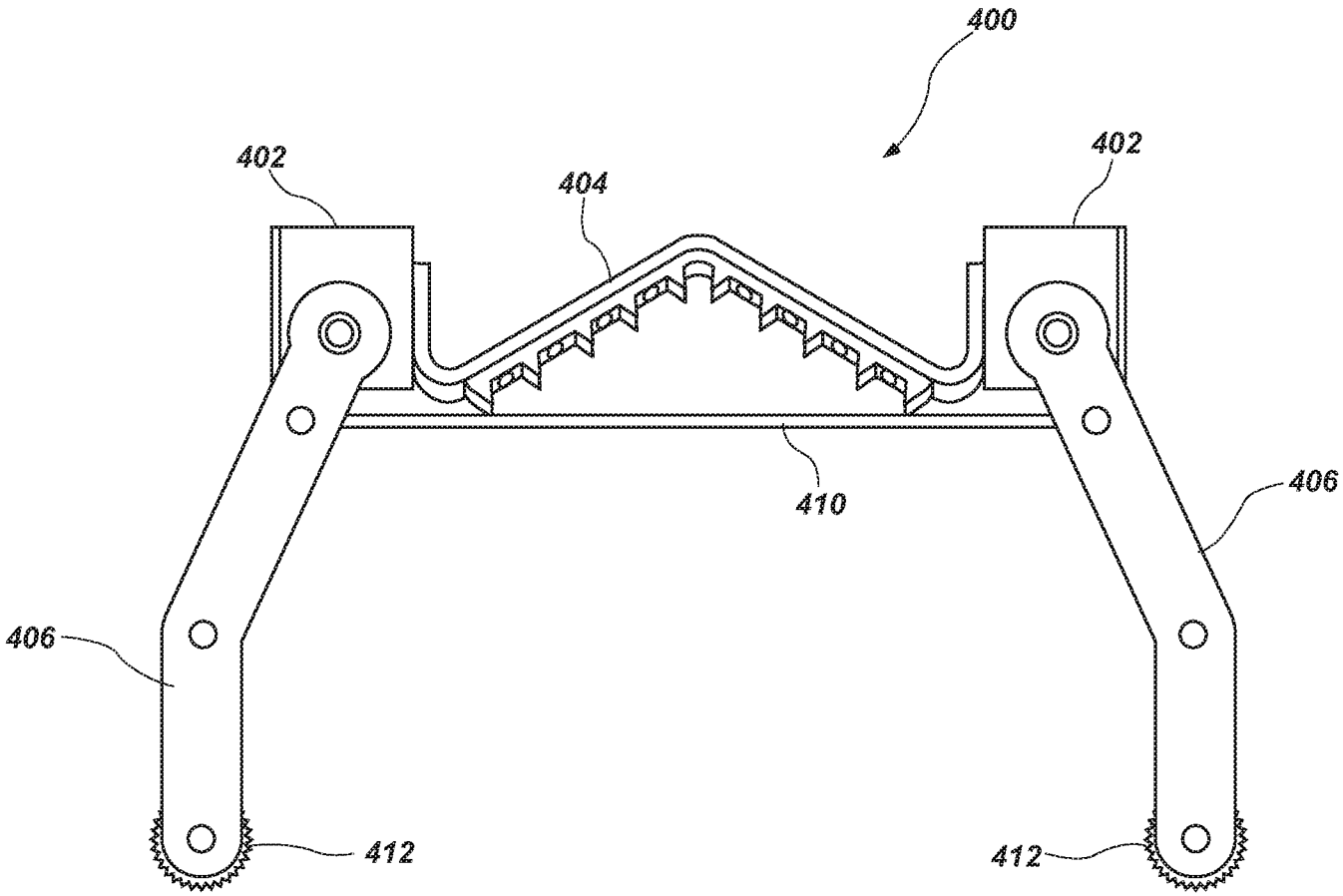

Referring now to FIGS. 8A-8C, another securing apparatus 400 is shown. The securing apparatus 400 is configured to engage a vertical support (e.g., a utility pole) and may be used, for example, by itself or in conjunction with the apparatus 100 described above or other securing or safety mechanisms. The securing apparatus 400 includes a pair of spaced apart brackets 402 configured to be coupled with the side rails of a ladder. A v-shaped cross-member 404 (also referred to as a V-bar) is coupled between the brackets 402 and configured to engage a vertical structure. It is noted that, for example, when used in conjunction with the apparatus 100 described above, the securing apparatus 400 may generally replace the V-bar 220 previously described.

The apparatus 400 further includes a pair of arms 406, each being pivotally coupled with an associated bracket 402 (e.g., by way of a shaft or pivot pin). A locking mechanism, such as a ratcheting mechanism 408, may be associated with the pivoting arms 406 (e.g., by way of a shaft or pivot pin) to enable the arms 406 to rotate in a first direction (i.e., inward towards each other), but inhibit rotation of the arms in a second direction (i.e., outward away from each other) until the ratcheting mechanism 408 is released.

A flexible cross member, such as a strap 410, extends between and is coupled to the pair of pivoting arms 406. During positioning of a ladder, the strap 410 will engage a vertical structure (e.g., a utility pole) prior to the v-bar 404 engaging the vertical structure. When the strap 404 is displaced by the vertical structure, it places a force on the arms 406, pulling them inwardly, until the vertical structure abuts the cross-member 404. This action causes the arms 406 to engage the vertical structure (e.g., the sides of a pole) such that an engagement structure 412 associated with the arms 406 grasps the structure. The engagement structure 412 may include teeth, barbs, roughened surfaces or other features in order to provide a more positive engagement between the arms 406 of the apparatus 400 and the vertical support structure. In the embodiment shown, the engagement structures 412 include a toothed gear structure that may rotate relative to its arm 406 when engaging and disengaging the pole or other support. When it is desired to release the arms 406 from the vertical structure, a lock associated with the ratcheting mechanism 408 may be actuated to enable the arms 406 to be displaced outwardly from one another. In one embodiment, a biasing member (e.g., a spring) may be associated with each of the arms 406 to cause them to be biased outwardly.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A ladder comprising:

a first pair of spaced apart rails;

a plurality of rungs extending between and coupled to the first pair of spaced apart rails;

a first hook positioned adjacent an upper end of a first rail of the first pair of spaced apart rails;

a second hook positioned adjacent an upper end of a second rail of the first pair of rails, wherein the first hook and the second hook are each configured to pivot through an angle of approximately 90° from a first position to a second position wherein, when in the second position, each of the first hook and the second hook is substantially within an envelope defined by the first pair of spaced apart rails;

a securing apparatus comprising:

a first engaging member positioned adjacent the first hook and being configured to pivot relative to the first hook, a second engaging member positioned adjacent the second hook and being configured to pivot relative to the second hook, and a member coupled to the first engaging member and to the second engaging member such that when the first engaging member pivots relative to the first hook, the second engaging member simultaneously pivots relative to the second hook, wherein the first engaging member and the second engaging member are each configured to pivot from an unengaged position to an engaged position, such that when the first engaging member and the second engaging member are each in the engaged position, the first engaging member and the first hook form a first encircling structure and the second engaging member and the second hook form a second encircling structure.

2. The ladder of claim 1, wherein the first engaging member is pivotally coupled to the first rail and the second engaging member is pivotally coupled to the second rail.

3. The ladder of claim 1, wherein the first hook pivots about a first axis, the second hook pivots about a second axis, and the first and second engaging members pivot about a third axis.

4. The ladder of claim 1, wherein the first engaging member is located on a first side of the first rail and the first hook is located on a second, opposing side of the first rail.

5. The ladder of claim 4, wherein the second engaging member is located on a first side of the second rail and the second hook is located on a second, opposing side of the second rail.

6. The ladder of claim 1, wherein the first hook and the second hook are each configured to pivot from the first position to the second position independent of any pivoting by the first and second engaging members.

7. The ladder of claim 1, further comprising a second pair of spaced apart rails and a second plurality of rungs extending between and coupled to the second pair of spaced apart rails, wherein the first pair of rails are slidably coupled with the second pair of rails.

8. The ladder of claim 1, wherein the first engagement member includes a first cup portion and the second engagement member includes a second cup portion.

9. The ladder of claim 8, wherein each of the first cup portion and the second cup portion includes an upper portion, a lower portion, and a central portion transitioning between the upper portion and the lower portion.

10. The ladder of claim 9, wherein the central portion includes an arcuate surface.

11. The ladder of claim 1, wherein the first engagement member includes a first engagement surface and the second engagement member includes a second engagement surface, wherein each of the first engagement surface and the second engagement surface includes a plurality of ridges.

* * * * *